US006478643B2

(12) United States Patent
Jolley

(10) Patent No.: US 6,478,643 B2
(45) Date of Patent: Nov. 12, 2002

(54) WATER PRESSURE AND VOLUME FLOW REGULATOR

(76) Inventor: Donald M. Jolley, 9350 Ann Harbor Dr., Gainesville, GA (US) 30506

( * ) Notice: Subject to any disclaimer, the term of this patent is extended or adjusted under 35 U.S.C. 154(b) by 0 days.

(21) Appl. No.: 09/755,816

(22) Filed: Jan. 5, 2001

(65) Prior Publication Data

US 2001/0031587 A1 Oct. 18, 2001

Related U.S. Application Data

(60) Provisional application No. 60/175,067, filed on Jan. 7, 2000.

(51) Int. Cl.[7] ..... B63H 21/10
(52) U.S. Cl. ..... 440/88
(58) Field of Search ..... 440/88, 89; 123/41.01, 123/41.02, 41.05, 41.08, 41.09, 41.13, 41.16, 41.17, 41.29, 25 A–25 H, 25 J–25 N, 25 P, 25 Q

(56) References Cited

U.S. PATENT DOCUMENTS

| | | | | | |
|---|---|---|---|---|---|
| 2,478,489 | A | * | 8/1949 | Kelson, Sr. | 123/41.08 |
| 3,105,472 | A | * | 10/1963 | Jasper | 123/41.08 |
| 3,358,654 | A | * | 12/1967 | Shanahan et al. | 123/41.08 |
| 3,521,610 | A | * | 7/1970 | Coudriet | 123/41.08 |
| 3,667,431 | A | * | 6/1972 | Kueny et al. | 123/41.08 |
| 3,918,418 | A | * | 11/1975 | Horn | 123/41.08 |
| 4,082,068 | A | * | 4/1978 | Hale | 123/41.02 |
| 4,133,284 | A | * | 1/1979 | Holcroft | 115/75 |
| 4,140,089 | A | * | 2/1979 | Kueny et al. | 123/41.08 |
| 4,312,304 | A | * | 1/1982 | Tyner | 123/41.74 |
| 4,357,912 | A | * | 11/1982 | Brown | 123/41.08 |
| 4,589,378 | A | * | 5/1986 | Hundertmark | 123/41.02 |
| 4,674,449 | A | * | 6/1987 | Hundertmark | 123/41.08 |
| 4,991,546 | A | * | 2/1991 | Yoshimura | 123/41.31 |
| 5,048,468 | A | * | 9/1991 | Broughton et al. | 123/41.74 |
| 5,330,376 | A | * | 7/1994 | Okumura | 440/88 |
| 5,904,605 | A | * | 5/1999 | Kawasaki et al. | 440/88 |
| 5,937,802 | A | * | 8/1999 | Bethel et al. | 123/41.74 |
| 6,012,956 | A | * | 1/2000 | Mishima et al. | 440/88 |
| 6,109,218 | A | * | 8/2000 | Bachschmid et al. | 123/41.08 |
| 6,135,833 | A | * | 10/2000 | Tsunoda | 440/88 |

FOREIGN PATENT DOCUMENTS

| | | | | |
|---|---|---|---|---|
| JP | 63-061732 | * | 3/1988 | 123/41.08 |
| JP | 11-257165 | * | 9/1999 | 123/41.08 |

* cited by examiner

*Primary Examiner*—S. Joseph Morano
*Assistant Examiner*—Ajay Vasudeva
(74) *Attorney, Agent, or Firm*—Womble Carlyle Sandridge & Rice, PLLC

(57) ABSTRACT

A water pressure and volume regulator for a marine engine includes a regulator body having a flow path defined therethrough. A piston is mounted along the flow path and is normally biased toward a closed position to block the passage of water along the flow path through the regulator. As the pressure within the water flow exceeds the biasing force urging the piston toward its closed position, the flow path is opened to enable to passage of excess water therethrough to help regulate and maintain a desired pressure of the water flow as it is supplied to the marine engine.

10 Claims, 2 Drawing Sheets

WATER PRESSURE AND VOLUME FLOW REGULATOR

This application claim benefit of No. 60/175,067-Jan. 7, 2000.

FIELD OF THE INVENTION

The present invention relates in general to water pressure regulators for engines, and more particularly to a water pressure and volume flow regulator for marine engines for which a water flow is drawn into and through the engine for cooling.

BACKGROUND OF THE INVENTION

Most marine engines for use with watercraft, typically rely on a flow of water routed from outside the watercraft through the engine via a water pump for cooling the engine to prevent the engine from overheating during use. Typically, a water pickup or inlet port has been on the exterior of the hull of the vessel or watercraft in which the engine is used and the water inlet line is connected to a water pump. The water pump generally is driven, such as by a belt drive, by the marine engine and operates to draw a flow of water into and through the inlet line and thereafter pump the water through the inlet line to an engine water inlet, where it is passed through the crankcase housing of the engine to cool the engine during operation. However, in most conventional marine engines, since the water pump is driven in direct relation to the output of the engine, as boat speed increases, as the engine RPMs are increased, the operation of the water pump is also correspondingly increased. As a result, the pressure and volume of the water flow being drawn into the water inlet also increases, typically exceeding desired levels. Forcing the excess water flow through the engine at higher levels can impair the performance of the engine and potentially can cause damage to the engine.

Accordingly, it can be seen that a need exists for a water pressure and flow regulator that solves the above discussed and other related and unrelated problems in the art.

SUMMARY OF THE INVENTION

Briefly described, the present invention relates to a water pressure regulator for regulating and enabling excess water flow to be diverted from an engine water flow cooling line in order to maintain the pressure and volume of the cooling water flow through the engine at a desired level. The water pressure and volume flow regulator typically is mounted along a water inlet line for a marine engine of a boat or other small watercraft. The regulator generally includes an inlet connected to the water inlet line for the engine, and an outlet connected to an exhaust or outlet line for exhausting the excess water flow overboard.

The regulator includes a regulator body through which a flow path is defined, extending from the inlet to the outlet thereof, and further includes a piston or gate, mounted along the flow path. The piston or gate generally is biased by spring pressure or other biasing mechanism into a normally closed position extending across the flow path through the regulator. As a result, the piston or gate generally blocks the flow path and prevents the flow of water through the body of the regulator. The setting of the biasing force acting on the piston or gate sets a control pressure for the regulator that must be overcome to enable an excess portion of the water flow to pass therethrough. This control pressure can be set at any desired level by varying the spring pressure or size of the regulator flow path in order to ensure there is a sufficient water flow through the engine for cooling without exceeding desired pressures in the engine.

As the pressure of the water flow passing through the water flow inlet line to the engine builds in excess of the control pressure value of the regulator, the piston or gate is caused to be moved from its closed position toward a fully open, retracted position. As the gate or piston is moved to an open position, the flow path through the body of the regulator is cleared, enabling excess water flow to be channeled away from the engine and through the regulator to the exhaust or outlet line for the engine. As a result, the pressure and volume of the water flow passing through the engine for cooling can be regulated and maintained at a desired level to prevent an undesirable buildup of pressure of the water flow passing through the engine.

DESCRIPTION OF THE INVENTION

Figure 1:
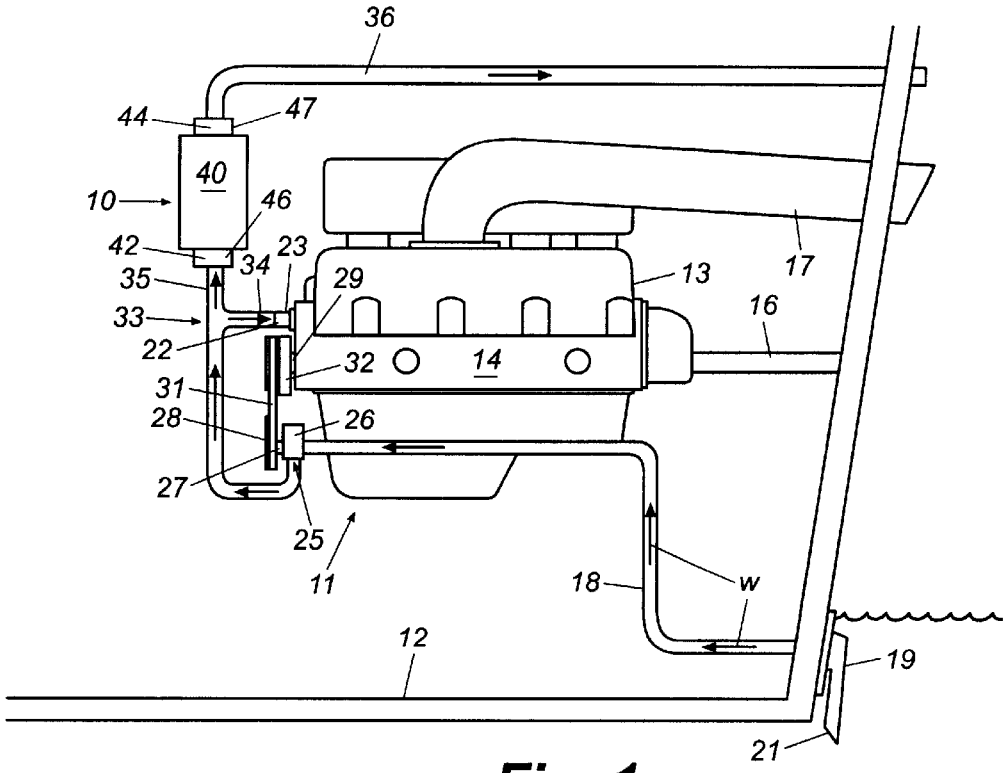
FIG. 1 is a schematic illustration of an engine within a vessel, including the water pressure and volume flow regulator of the present invention.

The present invention relates to a water pressure and volume flow regulator 10 for use with marine engines as indicated at 11 in FIG. 1, such as a conventional high performance marine engine mounted within the engine compartment within the hull 12 of a vessel or watercraft. As generally illustrated in FIG. 1, the engine 11 generally includes an engine body 13, including a piston or crankcase housing 14 from which a drive shaft 16 extends, and an exhaust 17. The drive shaft 16 generally is connected to a propeller or similar drive mechanism (not shown) for propelling the watercraft with the operation of the engine.

An engine water inlet line 18 extends through the engine compartment of the watercraft and includes a water pickup or port 19 mounted externally of the vessel hull. The water pickup or port 19 typically includes an open first or nozzle end 21 that generally is oriented in the direction of travel of the vessel, so that as the vessel is propelled by the engine, water is forced into the open end 21 of the water pickup and thus into the engine water inlet line 18. The engine water inlet line 18 extends from the water pickup 19 to a second end 22 that is connected to an engine inlet 23, where the water is received and is directed through the housing 14 of the engine body for cooling the engine 11 during operation.

A water pump 25 is mounted along the water inlet line 18 and includes a pump body 26 connected to a pump drive shaft 27 to which a belt driven wheel or gear 28 is attached. The drive shaft 27 of the water pump is linked to an output shaft 29 of the engine 11 by a belt 31 encircles about a belt or drive wheel 32 mounted to the end of the drive shaft 29. Accordingly, as the output shaft 29 is driven by the engine 11, the drive belt 31 translates this rotation to the drive shaft 27 of the water pump, so that the water pump is driven in direct relation to the output of the engine. Thus, as the speed of the engine is increased to increase the speed of the vessel or boat, the operation of the water pump is also increased. As a further result, the flow volume and pressure of the water flow being drawn through the water inlet line, as indicated by arrows W, also are increased.

Figure 2:
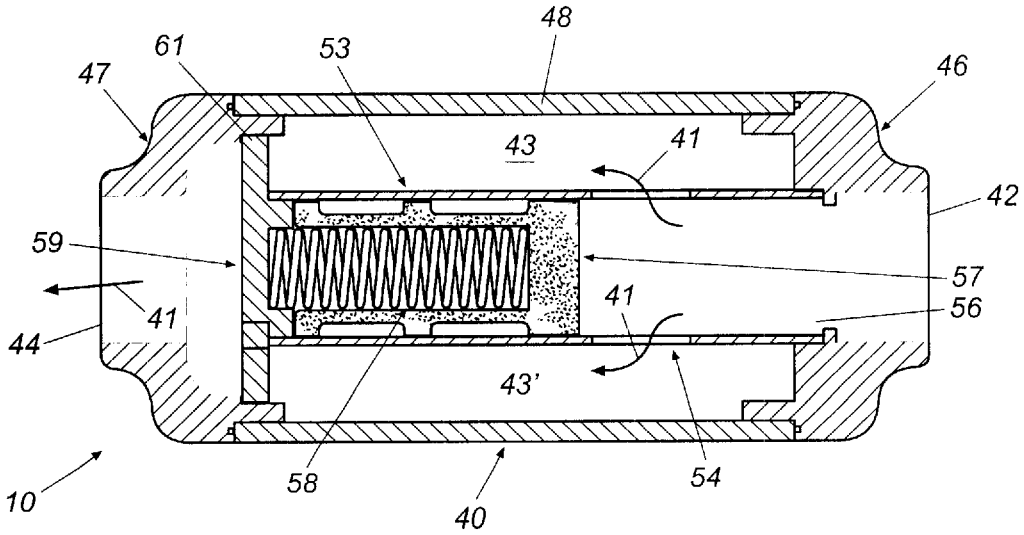
FIG. 2 is a side elevational view taken in cross section of the water pressure and volume flow regulator of the present invention with its piston in a fully retracted, open position.
Figure 3:
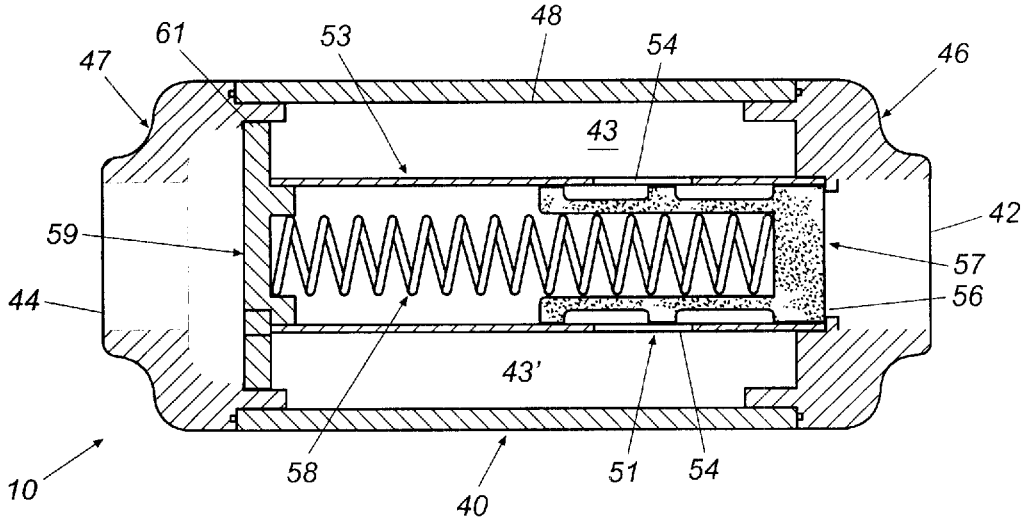
FIG. 3 is a side elevational view taken in cross section of the water pressure and volume flow regulator of the present invention with its piston in fully extended, closed position.

FIGS. 2 and 3 illustrate the water pressure and flow volume regulator 10 of the present invention in greater detail. The water pressure and flow volume regulator 10 is mounted along the water pressure inlet line 18, as shown in FIG. 1, upstream from an inlet "Y" junction 33 at which the water flow is split into an engine feed line 34 for passing into the engine water inlet 23, and a bypass line 35 that feeds to the water pressure and flow volume regulator 10. As the water pressure and volume of the water flow in the inlet line 18 increases to a desired or preset level in excess of a control pressure set for the regulator 10, the excess water of the water flow enters the regulator 10 where it can be bled off and channeled to an outlet water line or exhaust 36, which routes the excess water overboard and away from the engine as indicated in FIG. 1, to maintain the water pressure in the engine to a desired preset level.

As shown generally in FIGS. 2 and 3, the water pressure and volume flow regulator 10 typically includes a cylindrical body 40, although other shapes or configurations such as rectangular or square also can be used, defining a flow path indicated by arrows 41 in FIG. 2, therethrough. The flow path extends from an inlet opening or port 42, through side channels 43 and 43', to an outlet opening or port 44, to direct a flow of water through the regulator as needed to maintain a desired water pressure flowing through the engine. The regulator body 40 typically is made from a metal material such as stainless steel, aluminum, or it can be made from plastics, composites, or similar durable, high strength and corrosion resistant materials and includes a inlet cap 46 mounted to the bypass 35 (FIG. 1) of the engine water inlet line 18 and an end or outlet cap 47 mounted to the water outlet line 36.

As shown in FIGS. 2 and 3, the body of the water pressure and volume flow regulator generally defines an outer cylinder 48 within which a gate mechanism, here shown in a first embodiment as a piston assembly 51, is mounted along and partially obstructs the flow path 41 extending through the regulator body. The piston assembly 51 generally includes a piston cylinder 53, that extends at least partially along the length of the regulator body 40 and which includes a series of ports or openings 54, formed adjacent the inlet end 56 thereof. A piston 57 is moveably mounted within the piston cylinder 53 and is moveable from a retracted, open position, as shown in FIG. 2, to a fully extended, closed position, as shown in FIG. 3, to open and close the ports 54 formed in the piston cylinder to correspondingly enable or block the water flow from passing through the water pressure and volume flow regulator 10 along the flow path 41 (FIG. 2).

A spring 58 or similar biasing mechanism is mounted within the piston cylinder and engages the piston 57 in biasing contact. The spring 58 biases the piston rearwardly along the length of the piston cylinder toward its closed position shown in FIG. 3. A spring support 59 is mounted over the outlet end of the piston cylinder 53 and provides a surface against which the spring 58 is engaged and bears, to urge the piston along the length of the piston cylinder. The spring support 58 generally engages and is secured within a recess 61 formed in the end or outlet cap 47 to provide a stable, fixed surface against which the spring can bear. The biasing force exerted by the spring 58 on the piston sets the control pressure level of the regulator that must be exceeded or overcome by the pressure of the water flow in the water flow inlet line 18 before the regulator permits excess water flow to be directed from the engine and into the outlet line 36.

During the operation of the water pressure and flow volume regulator, as the speed of the watercraft to which the invention is mounted increases with the increased operation of the engine, the operation of the water pump likewise is increased so that the water pressure and the flow volume of the water flow through the water inlet line 18 for cooling the engine is increased. The water flow is directed through the inlet for the engine until the preset control pressure value is reached in the inlet line. This preset value is determinable by the biasing force of the spring 58, the diameter of the piston 57 and/or the size of the flow path through the regulator. Thus, the volume and pressure of the water flow being directed into the engine can be adjusted by adjusting or varying the bearing or biasing force exerted by the spring or other biasing mechanism used for urging the piston to its closed position, and/or by varying the size or diameter of the piston 57 to vary the amount of flow passing through the water pressure and flow volume regulator 10.

As the inlet pressure and volume of the water flow exceeds the preset control pressure level, the piston 57 is urged or moved to its open, fully retracted position, as shown in FIG. 2, so as to uncover or open the ports 54, formed in the piston cylinder. This provides the excess water with a direct flow path as indicated by arrows 41, through the water pressure and flow volume regulator to the outlet or exit cap and thus to the outlet line 34. This excess water can then be directed or routed overboard. As a result, the internal engine cooling water pressure is maintained at or below the desired preset level while still ensuring a sufficient flow of water through the engine for cooling. As the water flow from the pump increases from the increase in engine speed and ram affect due to the vessel's speed, the piston continues to uncover more of the port openings, so as to maintain the engine's water inlet pressure at the preset level.

When the piston is fully retracted or opened, the flow area of the port openings is greater than the area of the inlet cap opening. This allows the excess water flow, i.e., the full water flow through the inlet line 18, minus the flow of water into the engine needed for cooling, to be bypassed and routed overboard. Thereafter, as the engine speed is slowed and the pressure and volume of the inlet water drops back below the preset level, the piston is urged to its fully extended, closed position shown in FIG. 3 by the biasing force of the spring being applied to the piston so that the full water flow below the desired preset value for the water pressure and volume flow is routed through the engine for cooling.

Figure 4:
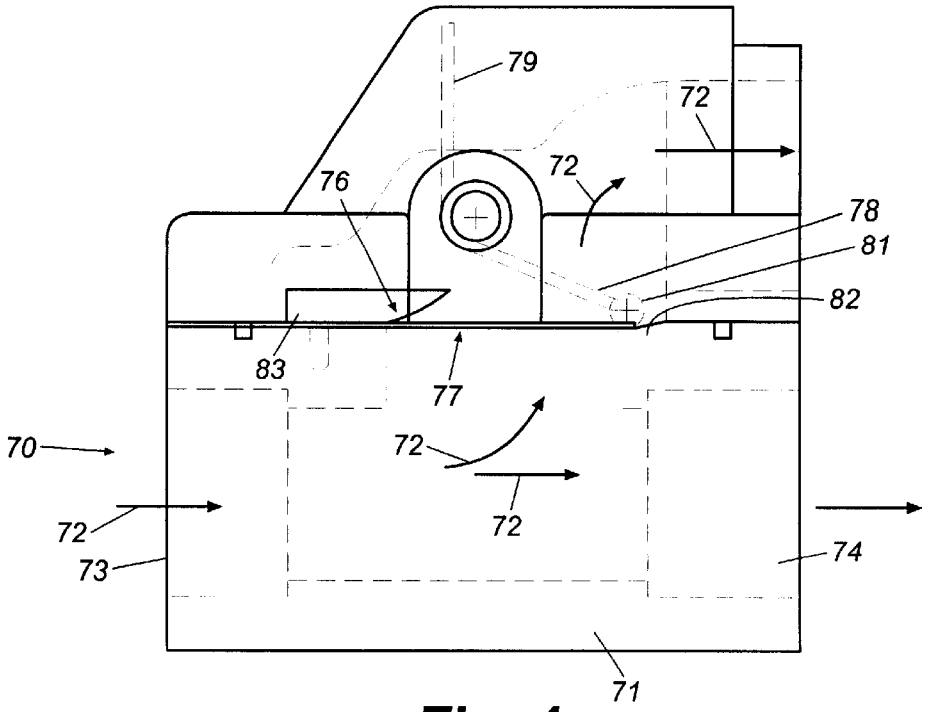
FIG. 4 is a side elevational view of a second embodiment of the water pressure and volume flow regulator of the present invention.

FIG. 4 illustrates an additional embodiment of the invention 70, having a reed valve type construction for the gate mechanism for controlling water flow through the regulator. In this embodiment, the regulator 70 again is mounted at the Y inlet connection of the water inlet line, and includes body 71 having a flow path defined therethrough, as indicated by arrows 72. The flow path extends from an inlet 73 through the body of the regulator, to an outlet 74 that is connected to the engine water inlet. A reed valve or gate 76 generally formed from a leaf spring or similar mechanism, is pivotally mounted along the flow path, and has a first arm or paddle 77 that normally extends across a flow opening or port 78. As in the above embodiment, the biasing force of the leaf spring sets the control pressure for opening the port. A torsion spring or springs (shown in dashed lines 79) also generally will be mounted adjacent and in engagement with the arm 77 of the reed or gate 76 to apply additional closing force as needed. A spring bar 81 typically is mounted to the spring(s) 79 and engages the arm 77 and provide even closing pressure to the end or edge of the arm 77 over the port 78.

The arm 77 of the reed valve or gate 76 normally is biased against a stop 82 so as to maintain the valve in a normally closed position. As the pressure in the water line increases above the control pressure, the arm 77 is moved to an open position to allow excess water to be diverted from the water inlet line to maintain the water pressure in the engine to a desired level. In addition, a reed stop 83 is mounted adjacent the reed or gate 76 to block movement of the arm 77 past a desired level to prevent the reed from being overstressed by the pressure of the excess water flow passing through the port 78.

It will be understood by those skilled in the art that while the invention has been disclosed above with reference to preferred embodiments, variations, modifications and additions can further be made to the invention without departing from the spirit and scope of the invention as set forth in the following claims.

I claim:

1. A marine engine for driving a watercraft, comprising:

an engine body having a water inlet line for providing a flow of water to said engine body;

a water pump mounted along said water inlet line and having a drive shaft connected by a drive belt to a drive shaft for the engine such that said water pump is driven by the engine for pumping the flow of water along said water inlet line to said engine body; and a pressure and volume flow regulator positioned along said water inlet line for receiving excess water from said water inlet line as pressure in said water inlet line exceeds a desired control pressure for maintaining the pressure in the water flow at a predetermined level, said regulator including:

a regulator body defining a flow path therethrough; and a piston mounted along said regulator body and moveable between a closed position and an open position exposing said flow path in response to the pressure of the water flow exceeding the desired control pressure to enable excess water to be directed away from said engine body and maintain the pressure of the water flow through the engine body at the predetermined level.

2. The engine of claim 1 and further comprising at least one port formed along said flow path of said pressure and volume flow regulator adjacent said piston to enable the water to flow into and through said regulator body.

3. The engine of claim 1 and further comprising a spring biasing said piston of said pressure and volume flow regulator toward its closed position to restrict the flow of water through said regulator body.

4. The engine of claim 1 and further including a spring mounted within said regulator body and exerting a biasing force against said piston for urging said piston toward the closed position, and wherein said predetermined pressure for moving said piston to the open position is determined by the biasing force of said spring.

5. The engine of claim 1 and further including a water pickup communicating with said water inlet line for directing the flow of water into said water inlet line as the engine drives the watercraft.

6. A regulator for regulating a water flow drawn through an engine to maintain a desired pressure of the water flow through the engine, comprising:

a regulator body having an inlet and an outlet and defining a flow path for the flow of water therethrough; and a gate mechanism mounted along said flow path and biased toward a closed position to block the flow of water along said flow path, said gate mechanism comprising a reed valve and being movable from its closed position to an open position in response to the pressure of the water flow exceeding a control pressure of said gate mechanism.

7. The regulator of claim 6 and further comprising at least one port formed along said flow path adjacent said gate mechanism to enable the water to flow into and through said regulator body.

8. The regulator of claim 6 and further comprising a spring biasing said gate mechanism toward its closed position to restrict the flow of water through said regulator body.

9. The regulator of claim 6 and further including a spring mounted within said regulator body and exerting a biasing force against said gate mechanism for urging said gate mechanism toward its closed position, and wherein said control pressure is determined by the biasing force of said spring.

10. The regulator of claim 6 and wherein said gate mechanism comprises a piston.

* * * * *